US005673069A

United States Patent [19]

Canfield et al.

[11] Patent Number: 5,673,069

[45] Date of Patent: Sep. 30, 1997

[54] METHOD AND APPARATUS FOR REDUCING THE SIZE OF DROPS EJECTED FROM A THERMAL INK JET PRINTHEAD

[75] Inventors: Brian Canfield, San Diego; Clayton Holstun, Escondido; King-Wah W. Yeung, Cupertino, all of Calif.

[73] Assignee: Hewlett-Packard Company, Palo Alto, Calif.

[21] Appl. No.: 283,965

[22] Filed: Aug. 1, 1994

Related U.S. Application Data

[63] Continuation of Ser. No. 983,009, Nov. 30, 1992, abandoned, which is a continuation-in-part of Ser. No. 694,185, May 1, 1991, Pat. No. 5,168,284.

[51] Int. Cl.[6] ..... B41J 2/07

[52] U.S. Cl. ..... 347/15; 347/17; 347/60; 347/14

[58] Field of Search ..... 347/14, 17, 60, 347/15

[56] References Cited

U.S. PATENT DOCUMENTS

| | | | |
|---|---|---|---|
| 4,262,188 | 4/1981 | Beach | 219/216 |
| 4,313,684 | 2/1982 | Tazaki et al. | 400/322 |
| 4,490,728 | 12/1984 | Vaught et al. | 346/1.1 |
| 4,510,507 | 4/1985 | Ishikawa | 346/76 PH |
| 4,660,057 | 4/1987 | Watanabe et al. | 346/140 R |
| 4,791,435 | 12/1988 | Smith et al. | 346/140 R |
| 4,910,528 | 3/1990 | Firl et al. | 346/1.1 |
| 5,036,337 | 7/1991 | Rezanka | 347/14 |
| 5,107,276 | 4/1992 | Kneezel et al. | 347/17 |
| 5,109,234 | 4/1992 | Otis, Jr. et al. | 347/14 |
| 5,168,284 | 12/1992 | Yeung | 346/1.1 |

FOREIGN PATENT DOCUMENTS

| | | | |
|---|---|---|---|
| 0416557A1 | 3/1991 | European Pat. Off. . | |
| 416557 | 3/1991 | European Pat. Off. | B41J 2/05 |
| 0511602A1 | 11/1992 | European Pat. Off. . | |
| 59-76275 | 10/1982 | Japan . | |
| 60-115457 | 6/1985 | Japan . | |
| 62-077946 | 4/1987 | Japan | B41J 2/365 |
| 62-077947 | 4/1987 | Japan | B41J 2/365 |
| 62-111750 | 5/1987 | Japan . | |
| 62-117754 | 5/1987 | Japan | B41J 2/365 |
| 2-78570 | 3/1990 | Japan . | |
| 4-131253 | 5/1992 | Japan . | |
| 2169855A | 7/1986 | United Kingdom . | |
| 2169856A | 7/1986 | United Kingdom . | |
| WO90/10541 | 9/1990 | WIPO . | |

*Primary Examiner*—Huan H. Tran

[57] ABSTRACT

The volume of drops ejected from thermal ink jet printheads varies with the temperature of the printhead. The variation in drop volume degrades print quality by causing variations in the darkness in black and white text, the contrast of gray scale images, and variations in the chroma, hue, and lightness of color images. The present invention reduces the range of drop volume variation by reducing the range of printhead temperature variation during the print cycle by keeping the printhead temperature above a reference temperature. When the printhead temperature falls below the reference temperature during a print cycle the printhead is heated with nonprinting pulses.

14 Claims, 7 Drawing Sheets

METHOD AND APPARATUS FOR REDUCING THE SIZE OF DROPS EJECTED FROM A THERMAL INK JET PRINTHEAD

CROSS REFERENCE TO RELATED APPLICATION(S)

This is a continuation of application Ser. No. 07/983,009 filed on Nov. 30, 1992, now abandoned, which is a continuation-in-part of a patent application that issued Dec. 1, 1992 as U.S. Pat. No. 5,168,284, having the Ser. No. 07/694,185 entitled METHOD AND APPARATUS FOR CONTROLLING THE TEMPERATURE OF THERMAL INK JET AND THERMAL PRINTHEADS THROUGH THE USE OF NONPRINTING PULSES filed in the name of Yeung on May 1, 1991 and owned by the assignee of this application and incorporated herein by reference. This application relates to application Ser. No. 07/982813 entitled INK-COOLED THERMAL INK JET PRINTHEADS; U.S. Pat. No. 5,459,498 filed in the name of Seccombe et. al on Nov. 30, 1992 and owned by the assignee of this application and is incorporated herein by reference.

FIELD OF THE INVENTION

This invention relates generally to the field of thermal ink jet printers and more particularly to controlling the temperature of thermal ink jet printheads.

BACKGROUND OF THE INVENTION

Thermal ink jet printers have gained wide acceptance. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Thermal ink jet printers produce high quality print, are compact and portable, and print quickly but quietly because only ink strikes the paper. The typical thermal ink jet printhead (i.e., the silicon substrate, structures built on the substrate, and connections to the substrate) uses liquid ink (i.e., colorants dissolved or dispersed in a solvent). It has an array of precisely formed nozzles attached to a printhead substrate that incorporates an array of firing chambers which receive liquid ink from the ink reservoir. Each chamber has a thin-film resistor, known as a thermal ink jet firing chamber resistor, located opposite the nozzle so ink can collect between it and the nozzle. When electric printing pulses heat the thermal ink jet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

Drop volume variations result in degraded print quality and have prevented the realization of the full potential of thermal ink jet printers. Drop volumes vary with the printhead substrate temperature because the two properties that control it vary with printhead substrate temperature: the viscosity of the ink and the amount of ink vaporized by a firing chamber resistor when driven with a printing pulse. Drop volume variations commonly occur during printer startup, during changes in ambient temperature, and when the printer output varies, such as a change from normal print to "black-out" print (i.e., where the printer covers the page with dots).

Variations in drop volume degrades print quality by causing variations in the darkness of black-and-white text, variations in the contrast of gray-scale images, and variations in the chroma, hue, and lightness of color images. The chroma, hue, and lightness of a printed color depends on the volume of all the primary color drops that create the printed color. If the printhead substrate temperature increases or decreases as the page is printed, the colors at the top of the page can differ from the colors at the bottom of the page. Reducing the range of drop volume variations will improve the quality of printed text, graphics, and images.

Additional degradation in the print quality is caused by excessive amounts of ink in the larger drops. When at room temperature, a thermal ink jet printhead must eject drops of sufficient size to form satisfactory printed dots. However, previously known printheads that meet this performance requirement, eject drops containing excessive amounts of ink when the printhead substrate is warm. The excessive ink degrades the print by causing feathering of the ink drops, bleeding of ink drops having different colors, and cockling and curling of the paper. Reducing the range of drop volume variation would help eliminate this problem.

SUMMARY OF THE INVENTION

For the reasons previously discussed, it would be advantageous to have an apparatus and a method for reducing the range of drop volume variation.

The foregoing and other advantages are provided by the present invention which reduces the range of the drop volume variation by maintaining the temperature of the printhead substrate above a minimum value known as the reference temperature. The present invention includes the steps of selecting a reference temperature that is greater than the maximum ambient temperature, measuring the printhead substrate temperature, comparing the printhead substrate temperature with the reference temperature keeping the printhead substrate temperature above the reference temperature, and reducing the volume of ink drops ejected from thermal ink jet printhead.

The scope of the present invention includes heating the printhead substrate during a print cycle (i.e., the interval beginning when a printer receives a print command and ending when it executes the last command of that data stream), as well as, heating it at anytime or heating it continuously. The scope of the present invention includes heating the printhead substrate by heating the entire cartridge (i.e., the printhead substrate, the housing, connections between the printhead substrate and the ink supply, and the ink supply if it is attached to the printhead substrate) by using a cartridge heater or heating the printhead substrate more directly by driving the firing chamber resistors with nonprinting pulses (i.e., pulses that do not have sufficient energy to cause the printhead to fire). The scope of the present invention includes using a thermal model to estimate the amount of heat to deliver to the printhead substrate to raise its temperature to the reference temperature and delivering this energy between swaths to avoid slowing the printer output.

Another aspect of the present invention varies the reference temperature according to the print resolution. When a cartridge prints at lower resolution (i.e., skipping every other dot), the space between the printed dots increases. The present invention reduces this empty space by increasing the reference temperature of the printhead substrate so that it produces larger dots. A further aspect of the present invention is a darkness knob that allows the user to vary the reference temperature and thereby control the darkness of the print and the time required for it to dry. The present invention includes a temperature sense resistor deposited around the firing chamber resistors of the printhead substrate.

The present invention has the advantage of reducing the range of drop volume variation and increasing the quality of the print. Other advantages of the invention include a reduction in the average drop volume since a smaller drop volume range allows the designer to set the average drop volume to a lower value, a reduction in the amount of ink that the paper must absorb, and more pages per unit ink volume whether the ink supply is onboard (i.e., physically attached to printhead substrate so that it moves with it) or offboard (i.e., stationary ink supply).

DETAILED DESCRIPTION OF THE INVENTION

A person skilled in the art will readily appreciate the advantages and features of the disclosed invention after reading the following detailed description in conjunction with the drawings.

Drop volume varies with printhead substrate temperature. The present invention uses this principle to reduce the range of drop volume variation by heating the printhead substrate to a reference temperature before printing begins and keeping it from falling below that temperature during printing. The preferred embodiment uses a thermal model of the printhead substrate to estimate how long to drive the printhead substrate at a particular power level to raise its temperature to the reference temperature of the printhead substrate.

Figure 1:
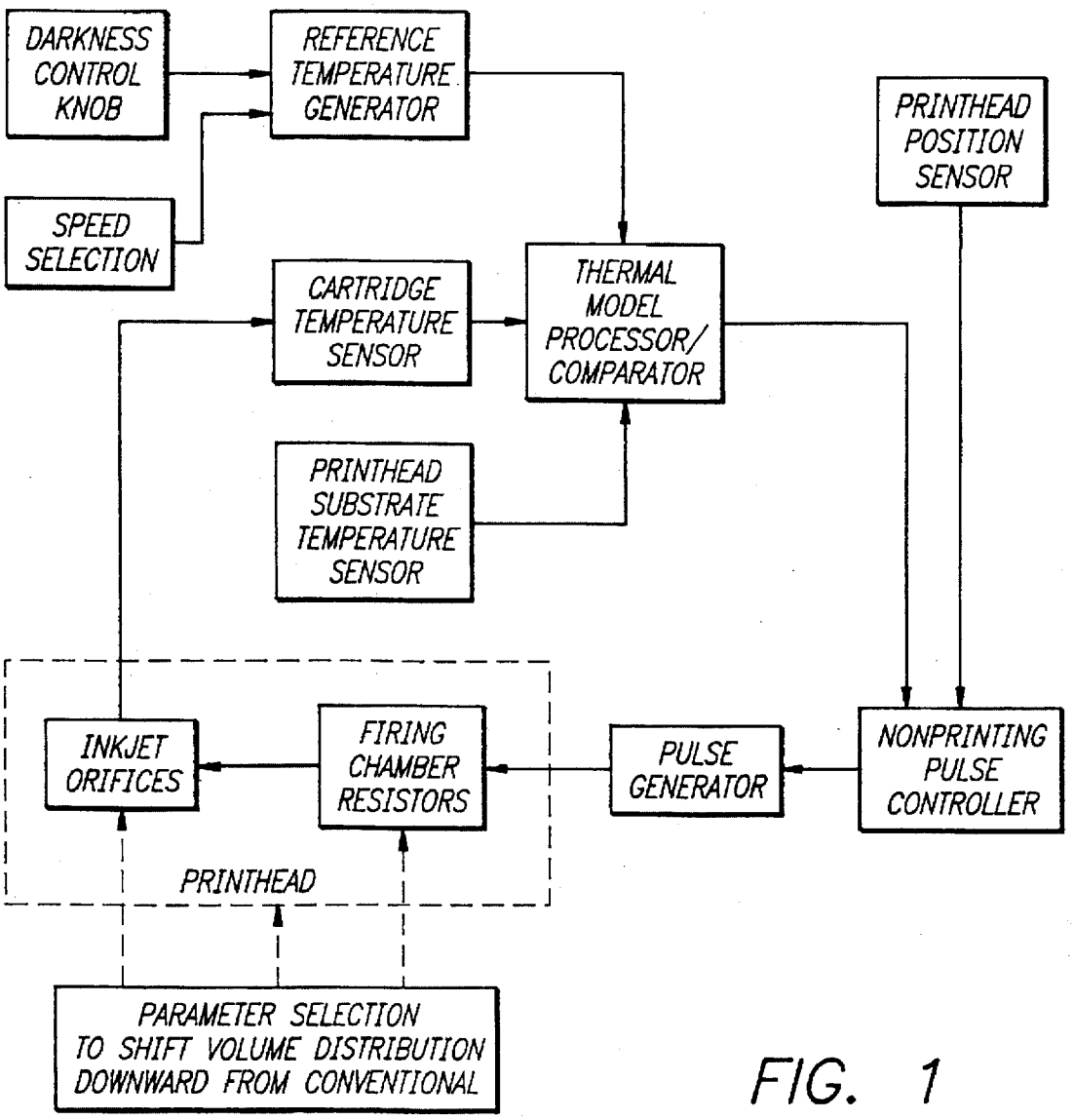
FIG. 1 is a block diagram of the present invention.

FIG. 1 is a block diagram of the preferred embodiment of the present invention. It consists of a printhead substrate temperature sensor 22, also shown in FIG. 6, a cartridge (i.e., the box that holds the ink and the printhead substrate) temperature (i.e., the air temperature inside the cartridge which is the ambient temperature of the printhead substrate) sensor, and a reference temperature generator. The outputs of these three devices are fed into a thermal model processor/comparator which calculates how long to drive the firing chamber resistors with nonprinting pulses having a known power. The preferred embodiment of the invention heats the printhead substrate only between swaths so it has a printhead position sensor that detects when the printhead is between swaths. The output of the thermal model and the output of the printhead position sensor goes to a nonprinting pulse controller that determines when the firing chamber resistors should be driven with nonprinting pulses. The output of the nonprinting pulse controller signals a pulse generator when to drive the firing chamber resistors with one or more packets of nonprinting pulses having the duration specified by the thermal model processor/comparator.

Figure 2:
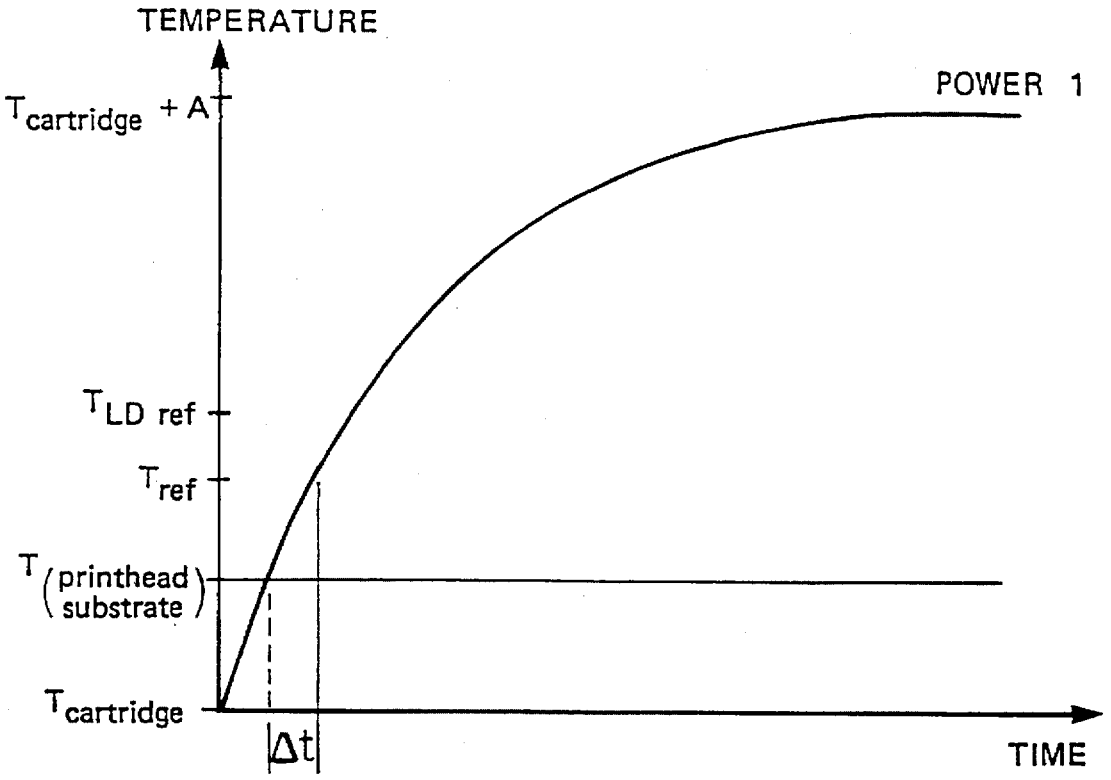
FIG. 2 is a plot of the thermal model of the printhead substrate used by the preferred embodiment of the invention.

FIG. 2 is a plot of the thermal model of the printhead substrate. The printhead substrate has an exponential temperature rise described by:

$$T_{printheadsubstrate}-T_{cartridge}=A(1-\exp^{-t/\tau}).$$

A and $\lambda$ are constants of the system. The inputs to the thermal model include: the reference temperature, the cartridge temperature (i.e., the temperature of the air inside the cartridge that surrounds the printhead substrate), and the printhead substrate temperature. The output parameter, $\Delta t$, shown in FIG. 2 is the length of time the firing chamber resistors should be driven with a $\text{Power}_1$ to heat the printhead substrate to the reference temperature. The equation that defines this time is:

$$t=\tau\left(\ln\left(\frac{T_{Cartridge}+A-T_{printheadsubstrate}}{T_{cartridge}+A-T_{ref}}\right)\right)$$

The advantage of the thermal model is that the printhead substrate reaches the reference temperature with reduced iterations of measuring the printhead substrate temperature and heating the printhead substrate. However, the thermal model is part of a closed-loop system and the system may use several iterations of measuring and heating if needed.

Figure 4A:
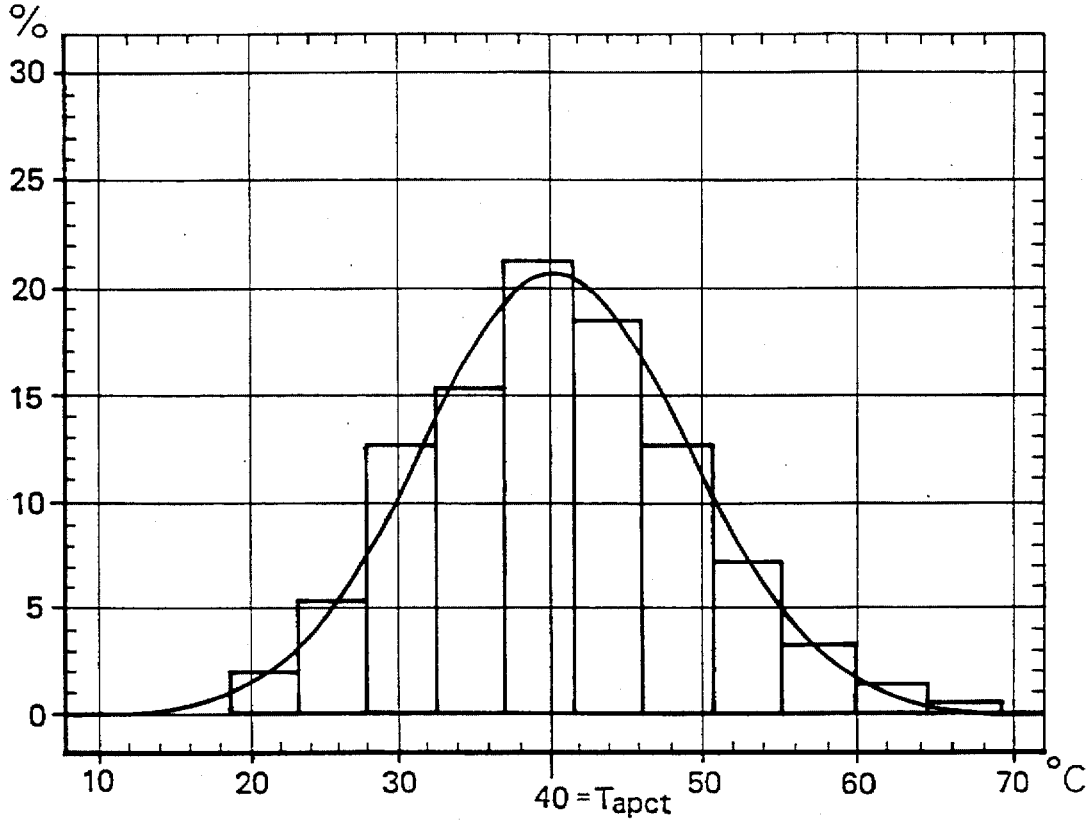
FIG. 4A is a histogram of the distribution of print-cycle temperatures that a population of printheads substrates without the present invention would experience over a typical range of user plots.

FIG. 4A is a histogram that represents the distribution of print-cycle temperatures that a population of printheads without the present invention would see over a typical range of user plots. The average print-cycle temperature of these printhead substrates without the invention is $T_{APCT}$ and equals 40° C. The preferred embodiment of the invention sets the reference temperature of a printhead substrate equal to $T_{APCT}$. This has the advantage of eliminating half the temperature range and, thus, half the drop volume variation due to temperature variation.

The preferred embodiment of the invention heats the printhead substrate to the reference temperature only during the print cycle. This has the advantage of keeping the printhead substrate at lower and less destructive temperatures for longer. Additionally, the preferred embodiment of the invention heats the printhead substrate only between swaths (i.e., passes of a printhead across the page) to reduce the load on the processor and prevent a reduction in the print speed. An alternate embodiment of the present invention heats the printhead substrate continuously. It measures the temperature of the printhead substrate as it moves across the paper. If it is below the reference temperature the machine will send either a printing pulse if the plot requires it or a nonprinting pulse. Alternate embodiments of the invention may heat the printhead substrate at anytime without departing from the scope of the invention.

The preferred embodiment of the invention heats the printhead substrate to the reference temperature by driving the firing chamber resistors with nonprinting pulses (i.e., pulses that heat the printhead substrate but are insufficient to cause the firing chamber resistors to eject drops). Alternate embodiments of the invention can heat the printhead substrate in any manner (e.g., printing pulses driving any resistive element, a cartridge heater, etc.) without departing from the scope of the invention.

In summary, the preferred embodiment uses a thermal model of the printhead substrate, having inputs of the reference temperature, the cartridge temperature, and the printhead substrate temperature, that calculates how long the firing chamber resistors of the printhead substrate should be driven with packets of nonprinting pulses delivering power at the rate of $Power_1$ to the printhead substrate between swaths to raise the printhead substrate temperature to the reference temperature.

Figure 3:
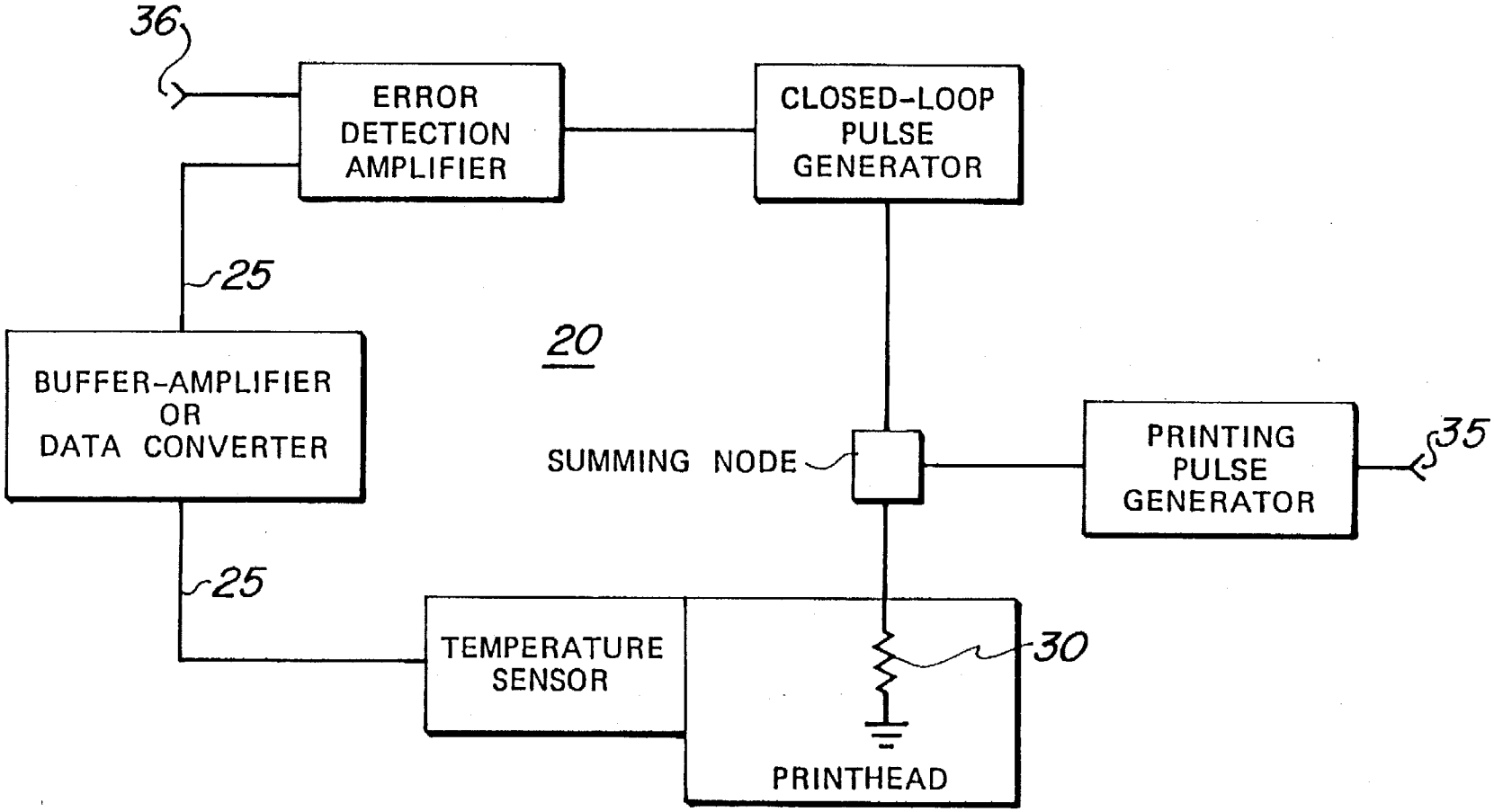
FIG. 3 is a block diagram of an alternate embodiment of the present invention.

FIG. 3 shows an alternate embodiment of the invention that uses an iterative approach to heating the printhead substrate to the reference temperature. The temperature sensor measures the printhead substrate temperature. An output signal 25 of the temperature sensor is processed by either a buffer-amplifier or a data converter and goes to an error detection amplifier that compares it to a reference temperature signal 36. If the printhead substrate temperature is less than the reference temperature, the closed-loop pulse generator will drive the firing chamber resistor with a series of nonprinting pulses. This process is repeated continuously during the print cycle. This and other aspects of the present invention are described in U.S. patent application Ser. No. 07/694,185 hereby incorporated by reference.

Figure 4B:
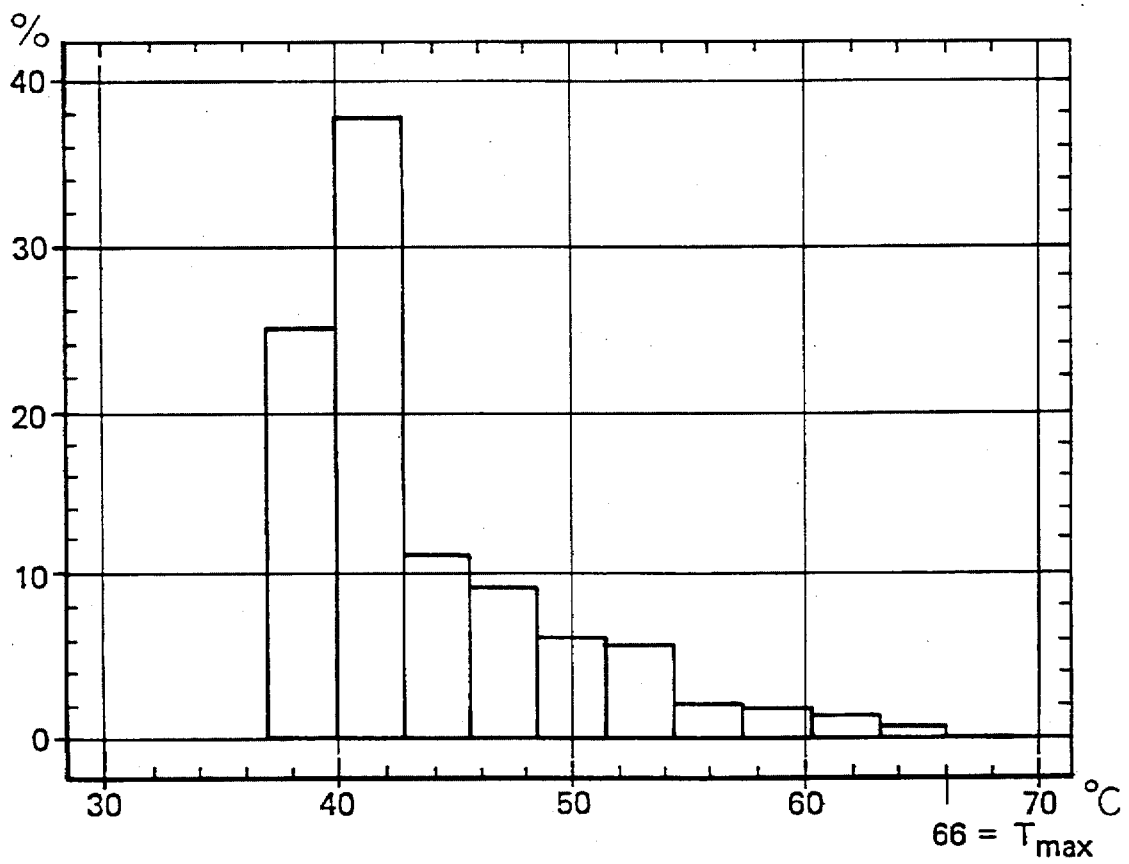
FIG. 4B is a histogram of the distribution of print-cycle temperatures that a population of printheads with the present invention would experience over the same typical range of user plots where the reference temperature equals 40° C.

As stated earlier, FIG. 4A is a histogram of the distribution of print-cycle temperatures for a printhead substrate without the present invention. The average print-cycle temperature, $T_{APCT}$, is 40° C. When the population of printhead substrates with the histogram of print-cycle temperature distributions shown in FIG. 4A adopts the present invention with the reference temperature set at $T_{APCT}$, 40° C., these printhead substrates obtain the histogram of print-cycle temperature distributions shown in FIG. 4B. It is a skewed-normal distribution with the lower temperatures of FIG. 4A avoided by use of the present invention. This printhead substrate made according to the preferred embodiment of the invention operates at the reference temperature of 40° C. most of the time but it does float up to higher temperatures including a maximum temperature (i.e., the highest printhead substrate temperature) when the print duty cycle is high in a warm environment.

As stated earlier the preferred embodiments of the present invention set the reference temperature equal to $T_{APCT}$ because this has the advantage of eliminating half the temperature range and half the range of drop volume variation due to temperature variation. Alternate embodiments could set the reference temperature equal to any temperature, such as above the maximum temperature, equal to the maximum temperature, somewhere between $T_{APCT}$ and the maximum temperature, or below $T_{APCT}$ without departing from the scope of the invention.

Another aspect of the invention, is a darkness control knob, shown in FIG. 1, that allows the user to change the reference temperature and thereby adjust the darkness of the print or the time required for the ink to dry according to personal preference or changes in the cartridge performance. Adjustments of the darkness control knob can cause the reference temperature to exceed the maximum temperature.

Raising the reference temperature has the advantage of reducing the range of printhead substrate temperature variation and if the reference temperature equals the maximum temperature, the printhead substrate temperature will not vary at all. But raising the reference temperature places increased stress on the printhead substrate and the ink and the likelihood of increased chemical interaction of the ink and the printhead substrate. This results in decreased reliability of the printhead. Also, a printhead substrate with a higher reference temperature will require more time for heating. Another disadvantage of raising the reference temperature is that all ink jet printer designs built to date have shown a higher chance of misfiring at higher printhead substrate temperatures.

Figure 5A:
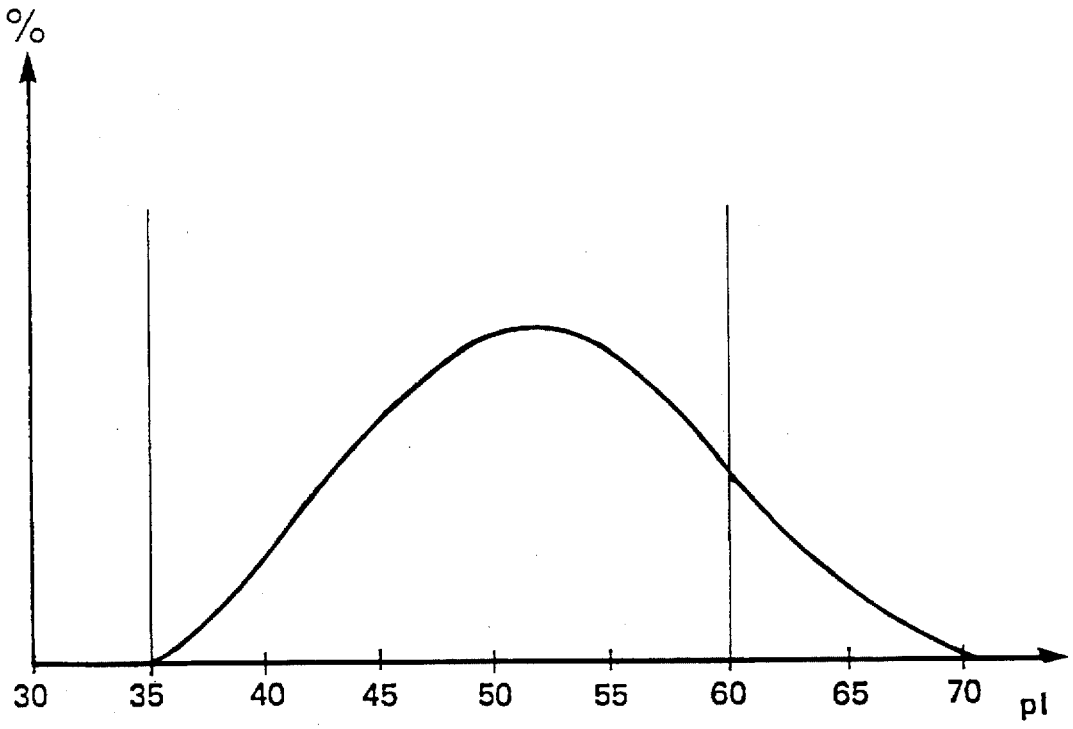
FIG. 5A is a plot of the distribution of drop volumes for a printhead substrate without the present invention.

FIG. 5A shows the drop volume range for a printhead substrate without the present invention. The X-axis is the volume of the drops and the Y-axis is the percentage of drops having that volume. The peak of the distribution curve is at 52.5 pico liters. The vertical lines are the lower acceptability limit (i.e., the smallest acceptable drops) and upper acceptability limit (i.e., the largest acceptable drop). The largest drops produced by a printhead substrate without the present invention exceed the upper acceptability limit and cause the feathering, bleeding, and block (i.e., the sleeve of a transparency film adheres to the printed area of the film and permanently changes the surface of the film) problems, as well as, the cockling and curling problems mentioned earlier.

Drop volume is a function of the printhead substrate temperature, geometric properties of the printhead such as resistor size or nozzle diameter, and the energy contained in a printing pulse. As shown in FIG. 5A, the drop volume range of printheads without the present invention is large. Typically, the drops ejected by previously-known printers at the cold, start-up printhead substrate temperatures are too small and produce substandard print. To produce larger drops at the cold, start-up temperatures, the properties of a printhead without the present invention, such as its geometry, must be adjusted so that the drops produced by a cold printhead substrate at power-on are large enough to produce satisfactory print (i.e., completely formed characters of adequate darkness). When these printhead substrates heat-up, they produce drops of excessively large volumes (as shown in FIG. 5A) that change the saturation level of the graphics, make the text bloomy, and create print that does not dry quickly and results in ink that bleeds, blocks, or smears and paper that cockles or curls. For these reasons, it is desirable to reduce the volume of the larger drops.

Figure 5B:
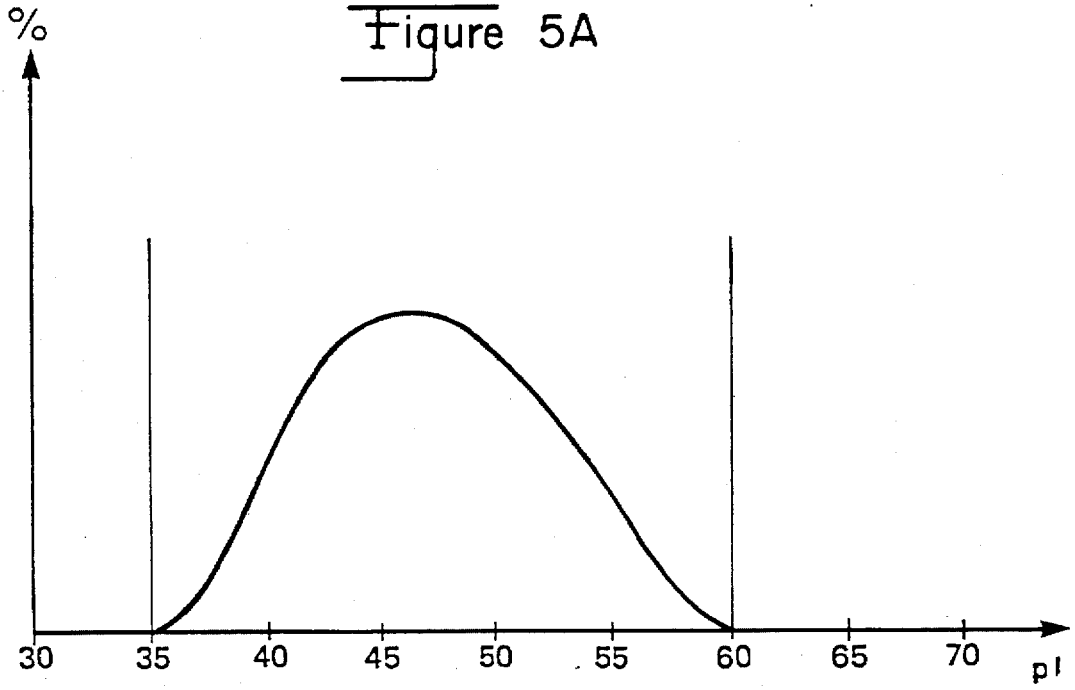
FIG. 5B is a plot of the distribution of drop volumes for a printhead substrate made according to the preferred embodiment of the invention.

FIG. 5B shows the drop volume range for a printhead substrate made according to the present invention. The peak of the distribution curve is at 47.5 pico liters and both the lower end and the upper end of the drop distribution fits inside the limits of acceptability. This skewed volume distribution was obtained by using the present invention which keeps the printhead substrate temperature from falling below the reference temperature and by shifting, or setting the entire range of drop volumes down to lower drop volumes. This is accomplished by changing the geometry of the printhead such as the size of the resistors and the orifice diameter. In other words the printhead (FIG. 1) itself, and in particular its selected parameters, here serve as means for setting or shifting downward the entire skewed distribution of volumes. Thus, an advantage of the present invention is that the largest drops can be eliminated by shifting down the entire range of drop volumes.

Figure 6:
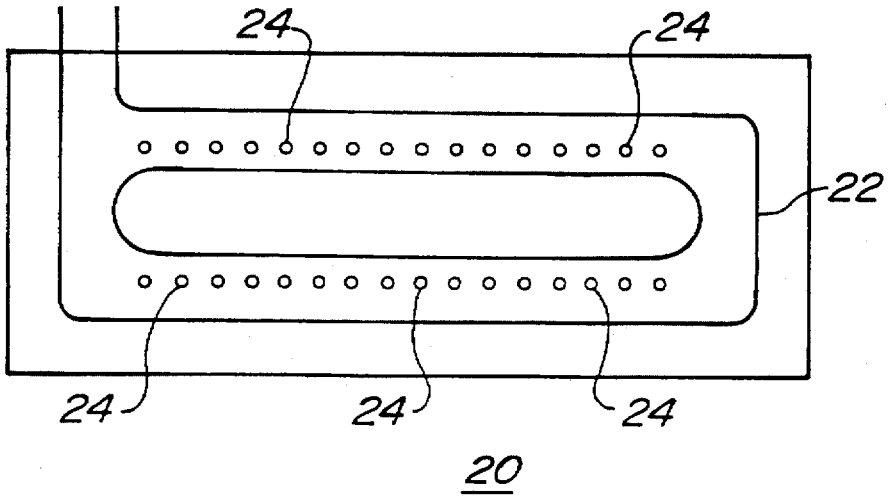
FIG. 6 shows the temperature sense resistor for the preferred embodiment of the present invention.

FIG. 6 shows the temperature sense resistor 22 that the preferred embodiment of the invention uses. Temperature sense resistor 22 measures the average temperature of a printhead substrate 20 since it wraps around all nozzles 24 of printhead substrate 20. The temperature of the ink in the drop generators is the temperature of greatest interest, but this temperature is difficult to measure directly but temperature sense resistor 22 can measure it indirectly. The silicon is thermally conductive and the ink is in contact with the substrate long enough that the temperature averaged around the head is very close to the temperature of the ink by the time the printhead ejects the ink.

Printhead substrate temperature sensor 22 is inexpensive to manufacture because it does not require any processing steps or materials that are not already a part of the manufacturing procedure for thermal ink jet printheads. However, it must be calibrated using standard calibration techniques, an accurate thermistor located in the printer box, and a known temperature difference between the printhead substrate and printer box. Other possibilities for calibrating printhead substrate temperature sensor 22 include laser trimming of the resistor.

The preferred embodiment of the invention heats the printhead substrate by using packets of nonprinting pulses. The power delivered by these packets equals the number of nozzles times the frequency of the nonprinting pulses (which can be much higher than that of the printing pulses since no drops are ejected from the printhead) times the energy in each nonprinting pulse. This power parameter is used to create the thermal model shown in FIG. 2. The number of nozzles and the frequency of the nonprinting pulses are constant and set by other aspects of the printhead design. Alternate embodiments of the invention can vary the frequency of the nonprinting pulses and pulse some but not all of the nozzles without departing from the scope of the invention.

In the preferred embodiment of the invention, the nonprinting pulses have the same voltage as the printing pulses so that the various time constants in the circuit are the same for printing pulses and nonprinting pulses. The pulse width and energy delivered by printing pulses are adjusted according the characteristics of each particular printhead. The width of nonprinting pulses is equal to or less than 0.48 times the width of the printing pulse so that it has little chance of ever ejecting ink from the printhead. In the preferred embodiment of the invention, the printing pulses have a width of 2.5 μsec. and the nonprinting pulses have a width of 0.6 μsec.

Figure 7A:
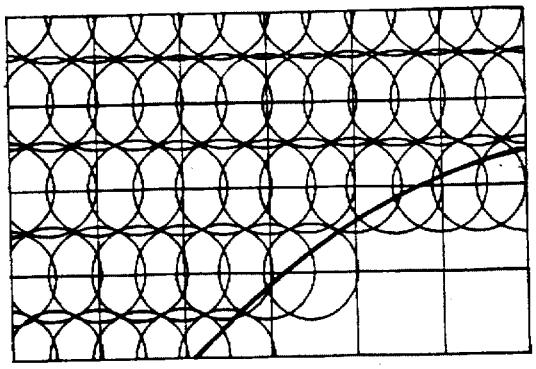
FIG. 7A shows print having a resolution of 300×600 dots per inch and FIG. 7B shows print having a resolution of 300×300 dots per inch.
Figure 7B:
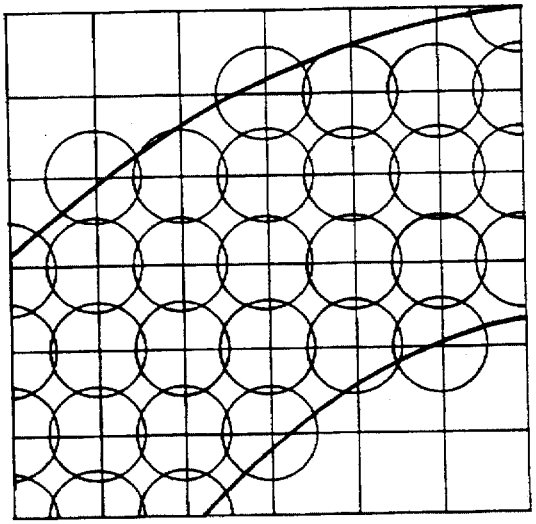
Figure 8:
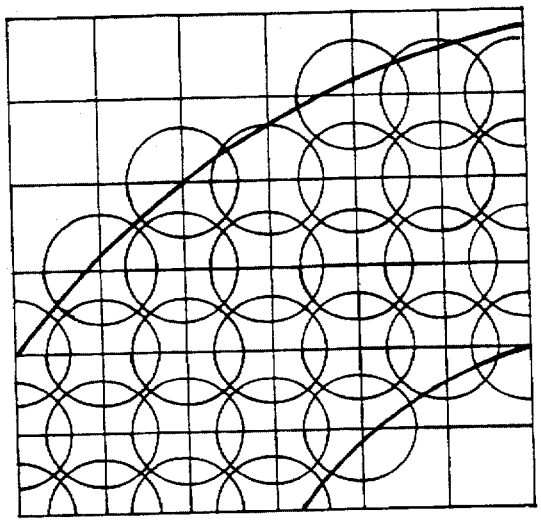
FIG. 8 shows the effect of increasing the drop size when printing at a resolution of 300×300 dots per inch.

The preferred embodiment of the invention changes the reference temperature with changes in resolution that are caused by a change in print speed. At the standard print speed, the resolution is 300 dots per inch along the paper feed axis and 600 dots per inch across the width of the paper in the carriage scan direction which translates into twice the number of dots across the width of the paper. FIG. 7A shows the coverage of dots in 300×600 dot per inch print. If the print speed is doubled, the printhead operates the same way but the resolution becomes 300×300 dots per inch. FIG. 7B shows the coverage of dots when the resolution is reduced to 300×300 dots per inch print. Holes open up between the dots. At the lower resolution modes, the present invention increases the reference temperature to $T_{LDref}$, shown in FIG. 2, so that the printhead ejects drops with a larger volume that produces larger dots that better fill in the empty space between the dots as shown in FIG. 8.

The increase in temperature between $T_{ref}$ and $T_{LDref}$ depends on how drop volume increases with temperature, the pl/°C. rating, and the dot size versus drop volume. If the printhead experiences 0.5 pl change per degree C., then switching from $T_{ref}$=40° C. to $T_{LDref}$=55° C. produce a drop volume change of 7.5 pl. Even though the reference temperature is increased, the pulse width and voltage remain the same.

All publications and patent applications cited in the specification are herein incorporated by reference as if each publication or patent application were specifically and individually indicated to be incorporated by reference.

The foregoing description of the preferred embodiment of the present invention has been presented for the purposes of illustration and description. It is not intended to be exhaustive nor to limit the invention to the precise form disclosed. Obviously many modifications and variations are possible in light of the above teachings. The embodiments were chosen in order to best explain the best mode of the invention. Thus, it is intended that the scope of the invention to be defined by the claims appended hereto.

What is claimed is:

1. A method for reducing variation in the drop volume of drops ejected from an inkjet printhead having an average print-cycle temperature and a maximum temperature, comprising the steps of:

a. selecting a reference temperature that is less than the maximum temperature;

b. measuring the printhead temperature;

c. comparing the printhead temperature with the reference temperature, during the print cycle; and d. restricting fluctuation of the printhead temperature, during the print cycle, to between the reference temperature and the maximum temperature by:

(1) heating the printhead when the printhead temperature is less than the reference temperature, (2) refraining from heating the printhead, except for heating used to produce printing and except for ambient temperature fluctuations, when the printhead temperature exceeds the reference temperature, and (3) allowing the printhead temperature to ascend to the maximum temperature so that the drop volume fluctuates between the volume of a drop ejected when the printhead temperature equals the reference temperature and the volume of a drop ejected when the printhead temperature equals the maximum temperature.

2. The method of claim 1, wherein:

the selecting step further comprises selecting a reference temperature that is slightly less than said average print-cycle temperature.

3. The method of claim 1, particularly for use with variable resolution of printing by said printhead; said method further comprising the step of:

increasing the reference temperature when a print resolution of the printhead is coarser.

4. The method of claim 1, further comprising the step of:

using a thermal model of the printhead to estimate an amount of heat needed to raise the printhead temperature to the reference temperature.

5. The method of claim 1, further comprising the step of:

varying the reference temperature in response to a user input.

6. The method of claim 1, wherein:

said heating of the printhead comprises driving a firing-chamber resistor on the printhead with nonprinting pulses.

7. The method of claim 1, wherein:

said heating of the printhead comprises heating the printhead between swaths.

8. The method of claim 1, wherein:

said heating of the printhead comprises heating the printhead during a print cycle.

9. An apparatus for reducing variation in the drop volume of drops ejected from an inkjet printhead having an average print-cycle temperature and a maximum temperature, comprising:

a. means for establishing a reference temperature that is less than the maximum temperature;

b. a printhead substrate temperature sensor that measures a printhead substrate temperature;

c. means for comparing the printhead substrate temperature and the reference temperature; and d. means for restricting fluctuation of the printhead temperature, during the print cycle, to between the reference temperature and the maximum temperature by:

(1) heating the printhead when the printhead temperature is less than the reference temperature, (2) refraining from heating the printhead, except for heating used to produce printing and except for ambient temperature fluctuations, when the printhead temperature exceeds the reference temperature, and (3) allowing the printhead temperature to ascend to the maximum temperature so that the drop volume fluctuates between the volume of a drop ejected when the printhead temperature equals the reference temperature and the volume of a drop ejected when the printhead temperature equals the maximum temperature.

10. The apparatus of claim 9, wherein:

the reference temperature is slightly less than said average print-cycle temperature.

11. Inkjet printing apparatus for printing by ejecting inkdrops, said apparatus having reduced temperature and volume of ejected inkdrops; and said apparatus comprising:

an inkjet printhead for ejecting inkdrops, said printhead having a distribution of operating temperatures and producing a corresponding distribution of inkdrop volumes;

means for heating the printhead to truncate a lower end of said distribution of temperatures and of said corresponding distribution of volumes, and so produce a skewed narrow distribution of temperatures and a corresponding narrow distribution of volumes; and means for setting the entire narrow distribution of volumes so that the upper end of the volume distribution does not exceed about sixty picoliters.

12. The apparatus of claim 11, further comprising:

means for applying a thermal model of the printhead to estimate an amount of heat for producing said skewed narrow temperature distribution; and means for applying said estimated heat to control the heating means to produce said skewed narrow temperature distribution.

13. Inkjet printing apparatus for printing by ejecting inkdrops, said apparatus having reduced temperature and volume of ejected inkdrops; and said apparatus comprising:

an inkjet printhead for ejecting inkdrops, said printhead having a distribution of operating temperatures and producing a corresponding distribution of inkdrop volumes;

means for establishing different resolutions of printing by the printhead, within a range from relatively coarse resolution through relatively fine resolution;

means for heating the printhead to truncate a lower end of said distribution of temperatures and of said corresponding distribution of volumes, and so produce a skewed narrow distribution of temperatures and a corresponding narrow distribution of volumes; and means for shifting the entire skewed narrow distribution of temperatures, and corresponding narrow distribution of volumes, toward higher temperature and higher volume when the resolution-establishing means establish said relatively coarse resolution.

14. Inkjet printing apparatus for printing by ejecting inkdrops, said apparatus having reduced temperature and volume of ejected inkdrops; said apparatus comprising:

an inkjet printhead for ejecting inkdrops, said printhead having a distribution of operating temperatures and producing a corresponding distribution of inkdrop volumes;

means for heating the printhead to truncate a lower end of said distribution of temperatures and of said corresponding distribution of volumes, and so produce a skewed narrow distribution of temperatures and a corresponding narrow distribution of volumes; and means for shifting the entire skewed narrow distribution of temperatures, and corresponding narrow distribution of volumes, in response to a user-operated print-darkness control.

* * * * *

UNITED STATES PATENT AND TRADEMARK OFFICE

CERTIFICATE OF CORRECTION

PATENT NO. : 5,673,069

DATED : September 30, 1997

INVENTOR(S) : Canfield et al.

It is certified that error appears in the above-identified patent and that said Letters Patent is hereby corrected as shown below:

Column 1, line 19, delete "PRINTHEADS" and insert in lieu thereof --PRINTHEAD--.

Signed and Sealed this

Fourteenth Day of April, 1998

Bruce Lehman

*Attest:*

BRUCE LEHMAN

*Attesting Officer*

*Commissioner of Patents and Trademarks*